United States Patent [19]

Loewe

[11] Patent Number: 5,031,854

[45] Date of Patent: Jul. 16, 1991

[54] WINDING ROLLER TO WIND AND UNWIND PHOTOPOLYMER MATERIAL

[75] Inventor: Erhard Loewe, Waldesch, Fed. Rep. of Germany

[73] Assignee: E. I. Du Pont de Nemours and Company, Wilmington, Del.

[21] Appl. No.: 509,417

[22] Filed: Apr. 9, 1990

[30] Foreign Application Priority Data

Apr. 21, 1989 [DE] Fed. Rep. of Germany ..... 8905036

[51] Int. Cl.[5] ..... B65H 75/14

[52] U.S. Cl. ..... 242/71.8

[58] Field of Search ..... 242/71.8, 71.9, 73, 242/118.4, 118.5, 118.6, 118.61

[56] References Cited

U.S. PATENT DOCUMENTS

| | | | |
|---|---|---|---|
| 777,957 | 12/1904 | Kelly | 242/71.9 |
| 1,839,223 | 1/1932 | Jones | 242/118.61 |
| 1,852,458 | 4/1932 | Hand | 242/71.8 X |
| 2,525,415 | 10/1950 | Lenox | 242/118.61 |
| 2,543,507 | 2/1951 | Rancourt | 242/68 |
| 3,297,155 | 1/1967 | Gattenby et al. | 206/59 |
| 3,468,492 | 9/1969 | Cragg | 242/71.8 |
| 3,474,900 | 10/1969 | Clark et al. | 242/118.4 X |
| 4,106,723 | 8/1978 | Couture | 242/118.4 |

FOREIGN PATENT DOCUMENTS

| | | | |
|---|---|---|---|
| 212203 | 3/1987 | European Pat. Off. . | |
| 703741 | 2/1954 | United Kingdom | 242/71.8 |

*Primary Examiner*—John M. Jillions

*Attorney, Agent, or Firm*—Thomas H. Magee

[57] ABSTRACT

A winding roller to wind and unwind photopolymeric material into a reel has two end disks which are slipped onto the two ends of a winding tube, respectively. Each end disk extends along a plane and has a substantially circular opening with an inner circumference of diameter $d_1$ through which the end of the winding tube is slipped. Each end disk has at least three clamping cams having tips extending radially inward beyond the inner circumference, each clamping cam being defined by radial indentations adjacent the inner circle which allow the cam to be flexibly bent away from the plane of the end disk. The outer diameter of the winding tube has a value which lies between the inner diameter $d_1$ of the end disk opening and the diameter $d_2$ of a circle defined by the tips of the clamping cams (10), whereby the clamping cams (10) work together with the winding tube according to the principle of frictional locking, thus ensuring that each end disk can only be moved on the winding tube in the slip-on direction.

2 Claims, 3 Drawing Sheets

WINDING ROLLER TO WIND AND UNWIND PHOTOPOLYMER MATERIAL

BACKGROUND OF THE INVENTION

1. Field of the Invention

This invention pertains to a winding roller, consisting of a winding tube and two end disks, to wind and unwind photopolymer films.

2. Description of the Related Art

European Patent Application No. 212,203 discloses a winding roller of the kind in which two end disks are slipped onto the protruding ends of the winding tube and pressed onto the end faces of the reel, thus becoming firmly attached. In order to form this attachment, according to the teaching of the above-mentioned application, the end disks are attached to the winding tube by means of clamping springs or of barbs, or else they are glued onto it. These embodiments require either additional parts (clamping springs) or materials (adhesive), or else they call for the winding tube to be provided with appropriate projections to support the barbs.

Another known embodiment is a winding roller which has been used by the applicant since 1977, consisting of a winding tube made of cardboard and two slip-on end disks (1), which have three clamping cams (3) on their inner circumference (2), as shown in FIGS. 1*a* and 1*b*. The inner diameter $d_1$ of the end disk opening and the dimensions of the clamping cams are chosen in such a way that the diameter of the winding tube, including its tolerance, has a value which lies between $d_1$ and the diameter $d_2$ of the circle defined by the tips of the clamping cams. When the end disks are slipped on, the winding tube is deformed, partially plastically, partially elastically, by the clamping cams. Consequently, the end disks can only be slid onto the winding tube with a certain amount of force. However, this deformation of the winding tube is not suitable for winding tubes made of hard material such as, for example, polystyrene.

The objective of the innovation is to design the end disks of this type of winding tube in such a way that the disks can be slipped onto a smooth winding tube in the direction of the end face of the film reel without the need to apply any substantial amount of force while, at the same time, preventing sliding in the opposite direction. In addition, the new end disks should not call for any additional parts or material for their attachment.

SUMMARY OF THE INVENTION

The present invention comprises a winding roller having two end disks which are slipped onto the two ends of a winding tube, respectively. Each end disk extends along a plane and has a substantially circular opening with an inner circumference of diameter $d_1$ through which the end of the winding tube is slipped. Each end disk has at least three clamping cams having tips extending radially inward beyond the inner circumference, each clamping cam being defined by radial indentations adjacent the inner circle which allow the cam to be flexibly bent away from the plane of the end disk. The outer diameter of the winding tube has a value which lies between the inner diameter $d_1$ of the end disk opening and the diameter $d_2$ of a circle defined by the tips of the clamping cams (10), whereby the clamping cams (10) work together with the winding tube according to the principle of frictional locking, thus ensuring that each end disk can only be moved on the winding tube in the slip-on direction.

DETAILED DESCRIPTION OF THE PREFERRED EMBODIMENTS

Figure 1A:
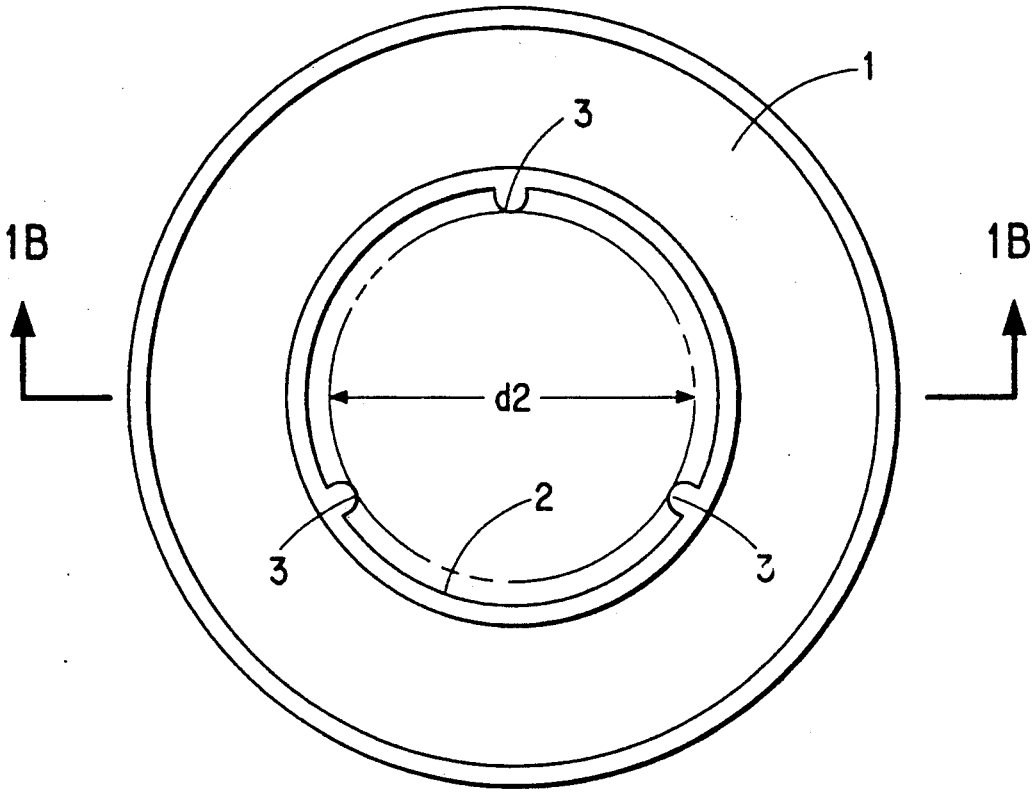
FIG.1A (PRIOR ART)
FIG. 1*a* is an elevation view showing a prior art end disk.
Figure 1B:
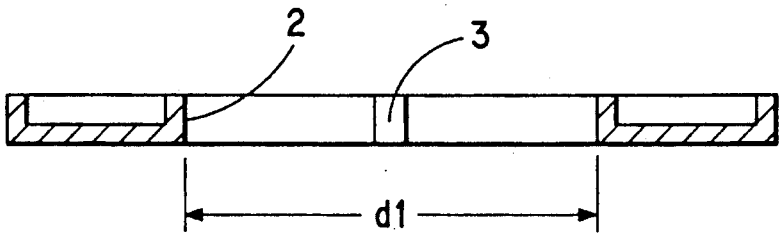
FIG.1B (PRIOR ART)
FIG. 1*b* is a cross-sectional view taken along line 1*b*—1*b* of FIG. 1*a*.
Figure 2A:
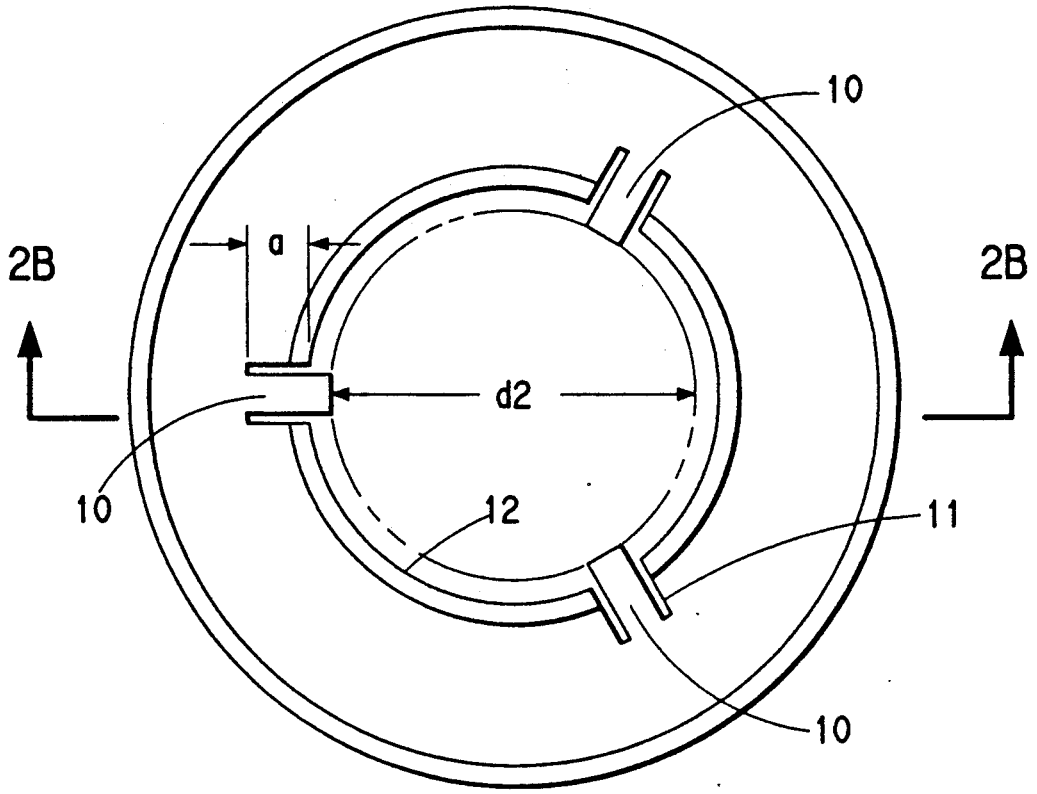
FIG. 2*a* is an elevation view showing one embodiment of the present invention.
Figure 2B:
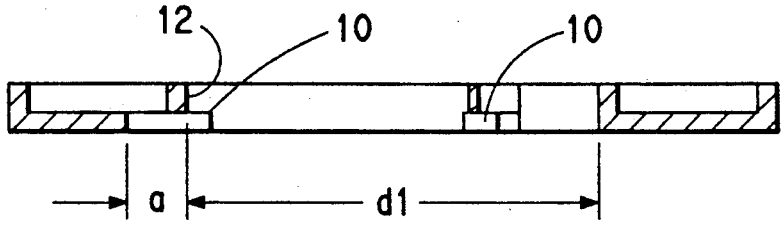
FIG. 2*b* is a cross-sectional view taken along line 2*b*—2*b* of FIG. 2*a*.

FIGS. 2*a* and 2*b* show an end disk according to the invention. This disk has radial indentations (11) on the inner diameter (12) of the end disk at the side of the clamping cams (10). As a result, the clamping cams (10) can be flexibly bent out of the plane of the end disk. This is achieved by slipping the end disk onto the winding tube, whose diameter is greater than the diameter $d_2$ of the circle defined by the tips of the clamping cams, but smaller than the inner diameter $d_1$ of the end disk. Once the clamping cams have been bent out of the plane of the end disk after they have been slipped on, the end disk can only be moved in the opposite direction if at least one of the clamping cams is broken by applying great force. Therefore, actuated by adherence, the end disk is fixed to the winding tube by means of self-reinforcing frictional force, which works according to the principle of frictional locking. In this respect, it differs from the state of the art, which describes constant frictional force caused by clamping springs or form-locking attachment with barbs.

On the basis of these properties, the end disk according to the invention can be fixed in any desired position on the winding tube, thus making it possible to optimally place it on the end faces of the film reel.

There must be at least three spring-clamped cams on each end disk. Especially in the case of winding tubes with larger diameters, it is advantageous to have more than three clamping cams.

The width of the clamping cams (10) lies preferably between 0.3% and 3% of the inner circumference of the end disk. For practical purposes, the length of the indentations (11) should be 0.5 to 10 times the thickness of the end disk material.

Figure 3A:
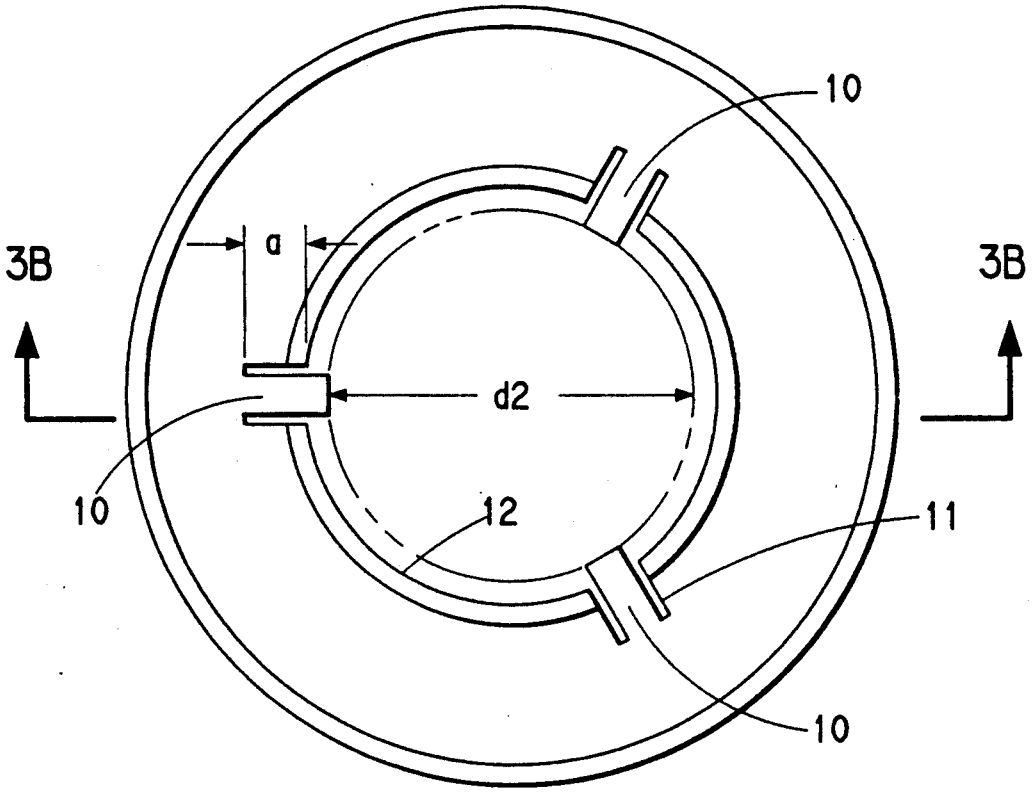
FIG. 3*a* is an elevation view showing another embodiment of the present invention.
Figure 3B:
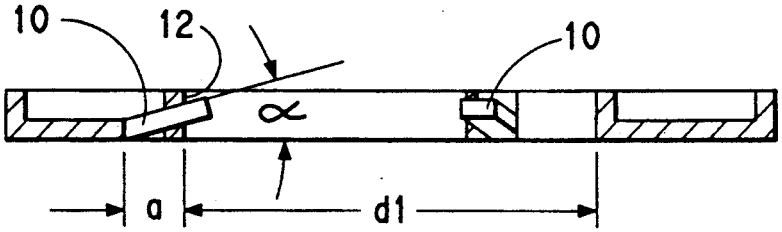
FIG. 3*b* is a cross-sectional view taken along line 3*b*—3*b* of FIG. 3*a*.

FIGS. 3*a* and 3*b* show an especially advantageous embodiment of the innovation wherein the clamping cams (10) form a small angle $\alpha = 5°$ to $15°$ with the plane of the end disk already in their unstressed position. In this case, the resistance against sliding in the direction opposite to the slip-on direction is even greater.

The end disks can be made in a simple manner by injection molding of a suitable thermoplastic, for example, ABS. When the innovation was implemented, it was surprisingly found that the end disks can be attached so firmly to the end faces of the film reel, that any emerging of the photopolymer material at the cutting edges as a result of cold flow is effectively prevented. Therefore, it is not necessary to decrease the winding tension in order to prevent the individual layers of film roll from sticking together.

The new winding roll can be employed for strip materials of all kinds, especially for photopolymer materials, in which a layer made of a photopolymerizable mixture is applied onto a carrier film, or optionally covered with a protective film, for instance, for dry-film resists, color-test films and copying films.

What is claimed is:

1. In a winding roller to wind and unwind photopolymeric material into a reel, the roller including a winding tube having an outer diameter and two ends adapted to protrude, respectively, from the end faces of the photopolymeric material reel, and two end disks attached to the two ends of the winding tube, respectively, each end disk extending along a plane and having a substantially circular opening with an inner circumference of diameter $d_1$ through which the end of the winding tube is slipped, the improvement in the winding roller comprising each end disk having at least three clamping cams (10) including tips extending radially inward beyond the inner circumference, each clamping cam defined by radial indentations (11) adjacent the inner circumference which allow the cam to be flexibly bent away from the plane of the end disk, said radial indentations (11) extending outwardly into each disk beyond the inner circumference of each disk, the outer diameter of the winding tube having a value which lies between the inner diameter $d_1$ of the end disk opening and the diameter $d_2$ of a circle defined by the tips of the unstressed clamping cams (10), whereby the clamping cams (10) work together with the winding tube according to the principle of frictional locking, thus ensuring that each end disk can only be moved on the winding tube in the slip-on direction.

2. A winding roller as defined in claim 1 wherein the clamping cams (10) in their unstressed position deviate by an angle $\alpha = 5°$ to $15°$ from the plane of the end disks.

* * * * *